United States Patent [19]

Lardi et al.

[11] 3,948,054

[45] Apr. 6, 1976

[54] STEAM TURBINE BLADE PROTECTION SYSTEM AND METHOD ESPECIALLY FOR ELECTRIC POWER PLANTS

[75] Inventors: Francesco Lardi; Donald J. Jones, both of Pittsburgh, Pa.

[73] Assignee: Westinghouse Electric Corporation, Pittsburgh, Pa.

[22] Filed: July 27, 1973

[21] Appl. No.: 383,201

[52] U.S. Cl. ..... 60/660

[51] Int. Cl.[2] ..... F01K 13/02

[58] Field of Search ..... 60/660–667; 415/17

[56] References Cited

UNITED STATES PATENTS 3,561,216 2/1971 Moore, Jr. ..... 415/17 X

*Primary Examiner*—Allen M. Ostrager

*Attorney, Agent, or Firm*—E. F. Possessky

[57] ABSTRACT

A protection system is provided for a turbine plant to avoid double shock or similar rotor blade operation. A digital computer controller detects excessive blade loading conditions on the basis of governor valve positions and effects bumpless mode transfer from sequential valve operation to single valve operation to avoid excessive blade loading.

25 Claims, 17 Drawing Figures

11

STEAM TURBINE BLADE PROTECTION SYSTEM AND METHOD ESPECIALLY FOR ELECTRIC POWER PLANTS

CROSS REFERENCE TO RELATED APPLICATIONS

The following copending patent applications assigned to the present assignee are cross-referenced:

Ser. No. 306,752 entitled "System And Method Employing Valve Management for Operating A Steam Turbine", filed by T. C. Giras, et al on Nov. 15, 1972.

Ser. No. 306,789 entitled "System And Method Employing Aspects of Valve Management For Operating A Steam Turbine", filed by L. B. Podolsky, et al on Nov. 15, 1972.

Ser. No. 306,943 entitled "System And Method Employing Bumpless Tracking For Steam Turbines Having Valve Management", filed by U. G. Ronnen, et al on Nov. 15, 1972.

Ser. No. 306,978 entitled "System And Method Employing General Aspects Of Valve Management For Operating A Steam Turbine," filed by T. C. Giras on Nov. 15, 1972.

Ser. No. 306,751 entitled "General Aspects of Valve Management System For Turbines," filed by M. Birnbaum on Nov. 15, 1972.

Ser. No. 306,790 entitled "Aspects Of Valve Management System For Turbines", filed by M. Burnbaum, et al on Nov. 15, 1972.

Ser. No. 306,942 entitled "System And Method Employing A General Implementation Of Valve Management For Digital Electro-Hydraulic Control Of A Steam Turbine With Valve Dynamic Function Generation," filed by L. Podolsky on Nov. 15, 1972.

Ser. No. 306,979 entitled "System And Method Employing A Computer Implementation Of Valve Management For A Steam Turbine With Valve Dynamic Function Generation", filed by U. G. Ronnen on Nov. 15, 1972.

BACKGROUND OF THE INVENTION

In the operation of turbine-generators in electric power plants, the electrical load supplied by the generator is dependent on the steam flow through the turbine. Typically, a plurality of governor valves function in parallel steam flow paths to control the total turbine steam flow in response to the operation of a turbine valve controller.

Each governor valve has associated with it a partial steam admission arc, i.e. an arcuate turbine region into which steam is admitted through nozzles or nozzle vanes from a nozzle block. If all of the governor valves are open, a continuous steam admission arc is formed fully about the turbine. Therefore, if all governor valves are operating in an open position the turbine is considered to be operating in a full arc mode, and if one or more governor valves are closed, the turbine is considered to be operating in a partial arc mode. Continuous arc operation is usually called single valve operation and partial arc operation is usually called sequential valve operation.

With respect to sequential valve operation, the turbine manufacturer typically defines the sequence in which the governor valves are to be operated to increase or decrease load, principally as a result of consideration of the effects of thermal and mechanical stresses on turbine life. Typically, single valve operation is used during turbine startup and/or load operation up to load levels where loss is throttling efficiency makes sequential valve operation desirable. Sequential valve operation is ordinarily employed to obtain higher heating rates at higher loads although it can be employed at lower loads and even during startup with some penalty from a rotor stress cycling standpoint.

Generally, undesirable time dependent force fields can be imposed on the rotating blades during partial arc turbine operation, and in certain cases the force field on the rotating blades can be such that a double or multiple blade shock condition exists. Highly desirable blade vibrations and blade vibratory stresses are generated during a multiple shock condition. Blade life is dependent on the blade cyclical stress history and it can especially be foreshortened by vibratory stresses associated with multiple blade shock. For this reason, double or multiple blade shock loading or other excessive cyclical blade loading is desirably avoided during turbine operation.

Generally, normal and steady and normal fluctuating drive stresses on the rotor blades are taken into account in the blade and rotor design and they therefore normally present no unusual problem. Although a time dependent temperature field can be applied to the rotating rotor blades during partial arc operation, the resulting blade thermal stresses are normally inconsequential as compared to the vibratory stresses associated with multiple shock.

Multiple blade shock can occur as a result of failure of one or more governor valves in the closed position such that other open valves produce two or more separate and partial steam admission arcs. In the double blade shock condition, the rotating rotor blades successively move through a first partial steam admission arc, a second partial arc through which no valve admitted steam flows, a third partial arc through which steam flows, a fourth partial arc through which no valve admitted steam flows, and then through the first partial arc to repeat the cycle. Each time a blade enters a partial steam admission arc, a shock occurs, i.e. a large increase occurs in the driving force on the rotor blade. During any one rotation, two blade shocks and associated blade vibratory stresses occur in the desired case. A greater number of blade shocks can occur in any one rotation according to the number of times a blade enters partial steam admission arcs or undergoes large increases in driving force during any one rotation.

In normal sequential valve operation, the manufacturer defined sequence for the governor valves is one in which the rotating blades undergo a single shock each rotation if there is at least one partial arc through which no steam is being admitted. Although single shock operation is undesirable to some degree, it is unavoidable and therefore must be tolerated during sequential valve operation.

In order to eliminate double blade shock or other undesirable blade loading which may occur in the sequential governor valve operating mode from time to time, the turbine can be protectively transferred from sequential valve operation to single valve operation to obtain a full steam admission arc. Of course, in certain cases, such as if a pair of arc displaced governor valves fail closed simultaneously, a double blade shock condition could exist even in the single valve operating mode and in that event it may not be possible to avoid the double shock without turbine shutdown.

While single valve operation can avoid excessive blade loading in the sequential mode, a transfer from sequential valve operation to single valve operation or vice versa does cause a rotor thermal stress cycle as a result of new rotor surface temperature conditions in the new mode. Therefore, protective mode transfers should not be initiated where the rotor stress cycle coat is not justifiable.

In the prior patent art such as Eggenberger U.S. Pat. No. 3,403,892, there is disclosed an electrohydraulic turbine valve control system in which analog control circuitry is provided for effecting automatic transfer between sequential valve and single valve operations with small load change while the turbine is operating on line. In the above noted copending applications there is disclosed a computer or a digital electrohydraulic turbine valve control system in which improved on-line valve transfers or valve management operations are provided. Although the prior art provides for a valve transfer capability, none of the known prior art is organized to provide rotor blade protection against undesirable blade loading and particularly against multiple shock while retaining bumpless turbine operation.

In the present application, no representation is made that any cited prior patent or other art is the best prior art nor that the interpretation placed on such art herein is the only interpretation that can be placed on that art.

SUMMARY OF THE INVENTION

An electric power generating plant is provided with a steam turbine which has a plurality of governor valves for supplying inlet steam to the turbine so as to drive a generator and produce electric power. A rotor blade protection system includes an arrangement for controlling the governor valves in a sequential valve mode or a single valve mode and for transferring the governor valves between the sequential and single valve modes while smoothly satisfying load demand. The rotor blade protection systems further includes a subsystem for detecting excessive rotor blade loading conditions in response to predetermined sensed parameters which are related to steam flow through the governor valves and for causing the governor valves to be transferred protectively from the sequential valve mode to the single valve mode if the turbine is in the sequential valve mode and if an excessive blade loading condition is detected.

DESCRIPTION OF THE PREFERRED EMBODIMENT

Electric Power Plant and Steam Turbine System

Figure 1:
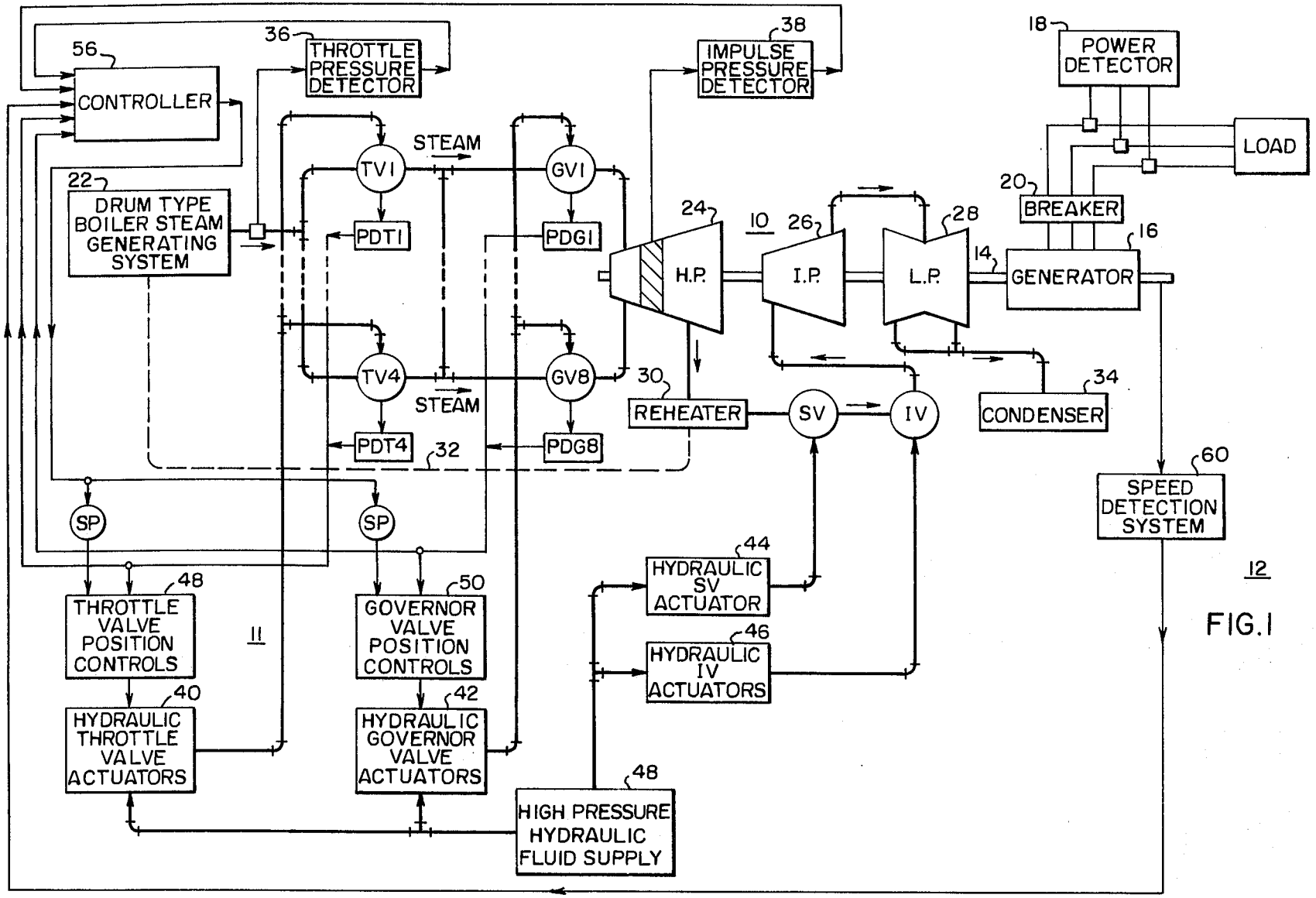
FIG. 1 shows a schematic diagram of an electric power plant arranged in accordance with the principles of the invention.

More specifically, there is shown in FIG. 1 a large single reheat steam turbine 10 constructed in a well known manner and operated by a control system 11 in a fossil electric power plant 12 in accordance with the principles of the invention. As will become more evident through this description, other types of steam turbines and electric power plants can also be operated in accordance with the principles of the invention. The turbine 10 and its control system 11 and the electric power plant 12 are like those disclosed in a copending patent application Ser. No. 247,877 entitled "System For Starting, Synchronizing and Operating a Steam Turbine With Digital Computer Control", filed by R. Uram on Apr. 26, 1972 and assigned to the present assignee.

The turbine 10 is provided with a single output shaft 14 which drives a conventional large alternating current generator 16 to produce three-phase electric power sensed by a power detector 18. Typically, the generator 16 is connected through one or more breakers 20 per phase to a large electric power network and when so connected causes the turbo-generator arrangement to operate at synchronous speed under steady state conditions. Under transient electric load change conditions, system frequency may be affected and conforming turbo-generator speed changes would result.

After synchronism, power contribution of the generator 16 to the network is normally determined by the turbine steam flow which in this instance is supplied to the turbine 10 at substantially constant throttle pressure. The constant throttle pressure steam for driving the turbine 10 is developed by a steam generating system 22 which may for example be provided in the form of a conventional drum or once through type boiler operated by fossil fuel such as pulverized coal, natural gas or oil.

In this case, the turbine 10 is of the multistage axial flow type and it includes a high pressure section 24, an intermediate pressure section 26, and a low pressure section 28. Each of the turbine sections may include a plurality of expansion stages provided by stationary vanes and in interacting bladed rotor connected to the shaft 14.

The turbine 10 in this instance employs steam chests of the double ended type, and steam flow is directed to the turbine steam chests (not specifically indicated) through four main inlet valves or throttle inlet valves TV1–TV4. Steam is directed from the admission steam chests to the first high pressure section expansion stage through eight governor inlet valves GV1–GV8 which are arranged to supply steam to inlets arcuately spaced about the turbine high pressure casing to constitute a somewhat typical governor valve arrangement for large fossil fuel turbines. Nuclear turbines on the other hand typically utilize only four governor valves. Generally, various turbine inlet valve configurations can involve different numbers and/or arrangements of inlet valves.

In applications where the throttle valves have a flow control capability, the governor valves GV1–GV8 are typically all fully open during all or part of the startup process and steam flow is then varied by full arc throttle valve control. At some point in the startup and loading process, transfer is normally and preferably automatically made from full arc throttle valve control to full arc governor valve control because of throttling energy losses and/or reduced throttling control capability. Upon transfer, the throttle valves TV1–TV4 are fully open, and the governor valves GV1–GV8 are positioned to produce the steam flow existing at transfer. After sufficient turbine heating has occurred, the operator would typically transfer from full arc governor valve control to partial arc governor valve control to obtain improved heating rates.

In the partial arc mode, the governor valves are operated in a predetermined sequence usually directed to achieving thermal balance on the rotor and relatively reduced rotor blade stressing while producing the desired turbine speed and/or load operating level. For example, in a typical governor valve control mode, governor valves GV5–GV8 may be initially closed as the governor valves GV1–GV4 are jointly operated from time to time to define positions producing the desired total steam flow. After the governor valves GV1–GV4 have reached the end of their control region, i.e. upon being fully open or at some overlap point prior to reaching fully open positions, the governor valves GV5–GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing.

If the main steam inlet valves are stop valves without flow control capability as is often the case in nuclear turbines, initial steam flow control is achieved during startup by means of a single wave mode of governor valve operation. Transfer can then be made to sequential governor valve operation at an appropriate load level.

In the described arrangement with throttle valve control capability, the preferred turbine startup and loading method is to raise the turbine speed from the turning gear speed of about 2 rpm to about 80% of the synchronous speed under throttle valve control, then transfer to full arc governor valve control and raise the turbine speed to the synchronous speed, then close the power system breakers and meet the load demand with full or partial arc governor valve control. On shutdown, governor valve control or coastdown may be employed. Other throttle/governor valve transfer practice may be employed but it is unlikely that transfer would be made at a loading point above 40% rated load because of throttling efficiency considerations.

Similarly, the conditions for transfer between full arc and partial arc governor valve control modes can vary in other applications of the invention. For example, on a hot start it may be desirable to tranfer from throttle valve control directly to partial arc governor valve control at about 80% synchronous speed.

After the steam has crossed past the first stage impulse blading of the first stage reaction blading of the high pressure section, it is directed to a reheater system 30 which is associated in heat transfer relation with the steam generating system 22 as indicated by the reference character 32. With a raised enthalpy level, the reheated steam flows from the reheater system 30 through the intermediate pressure turbine section 26 and the low pressure turbine section 28. From the latter, the vitiated steam is exhausted to a condenser 34 from which water flow is directed (not indicated) back to the steam generating system 26.

To control the flow of reheat steam, one or more reheat stop valves SV are normally open and closed only when the turbine is tripped. Interceptor valves IV (only one indicated), are also provided in the reheat steam flow path.

In the typical fossil fuel drum type boiler steam generating system, the boiler control system operates the boiler so that steam throttle pressure is controlled to be substantially constant or within a predetermined range of values. A throttle pressure detector 36 of suitable conventional design senses the steam throttle pressure for data monitoring and/or turbine or plant control purposes. If desired in nuclear or other plant applications, turbine control action can be directed to throttle pressure control as well as or in place of speed and/or load control.

In general, the steady state power or load developed by a steam turbine supplied with substantially constant throttle pressure steam is proportional to the ratio of first stage impulse pressure to throttle pressure. Where the throttle pressure is held substantially constant by external control, the turbine load is proportional to the first stage impulse pressure. A conventional pressure detector 38 is employed to sense the first stage impulse pressure for assigned control usage in the turbine control 11.

A speed detection system 60 is provided for determining the turbine shaft speed for speed control and for frequency participation control purposes. The speed detector 60 can for example include a reluctance pickup (not shown) magnetically coupled to a notched wheel (not shown) on the turbo-generator shaft 14. In the present case, a plurality of sensors are employed for speed duration.

Respective hydraulically operated throttle valve actuators 40 and governor valve actuators 42 are provided for the four throttle valves TV1–TV4 and the eight governor valves GV1–GV8. Hydraulically operated actuators 44 and 46 are also provided for the reheat stop and interceptor valves SV and IV. A high pressure hydraulic fluid supply 48 provides the controlling fluid for actuator operation of the valves TV1–TV4, GV1–GV8, SV and IV. A lubricating oil system (not shown) is separately provided for turbine plant lubricating requirements.

The inlet valve actuators 40 and 42 are operated by respective electrohydraulic position controls 48 and 50 which form a part of the control system 11. If desired, the interceptor valve actuators 46 can also be operated by a position control (not shown).

Figure 2:
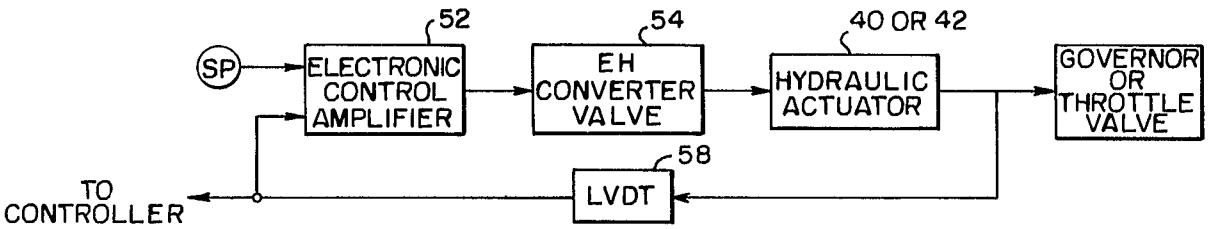
FIG. 2 shows a schematic diagram of an electrohydraulic position control loop employed for operating turbine governor and throttle valves associated with the plant of FIG. 1.

Each position control includes a conventional electronic control amplifier 52 (FIG. 2) which drives a Moog valve 54 or other suitable electrohydraulic (EH) converter valve in the well known manner. Since the turbine power is proportional to steam flow under substantially constant throttle pressure, inlet valve positions are controlled to produce control over steam flow as an intermediate variable and over turbine speed and/or load as an end control variable or variables. The actuators position the steam valves in response to output position control signals applied through the EH converters 54. Respective valve position detectors PDT1–PDT4 and PDG1–PDG8 are provided to generate respective valve position feedback signals which are combined with respective valve position setpoint signals SP to provide position error signals from which the control amplifiers 52 generate the output control signals.

The setpoint signals SP are generated by a controller 56 which also forms a part of the control system 11. The position detectors are provided in suitable conventional form, for example they may be linear variable differential transformers 58 (FIG. 2) which generate negative position feedback signals for algebraic summing with the valve position setpoint signals SP.

The combination of the amplifier 52, converter 54, hydraulic actuator 40 or 42, and the associated valve position detector 58 and other miscellaneous devices (not shown) form a local analog electrohydaulic valve position control loop 62 for each throttle or governor inlet steam valve. In the present case, the local analog electrohydraulic valve position control loop is preferably included in the control system 11 even where the controller 56 includes a programmed digital computer because of the combined effects of control computer operating speed capabilities and computer hardware economics, i.e. the cost of a manual backup analog control, which is readily interfaced with the local analog valve position loops, is less than that for a backup digital computer control at present control computer operating speeds for particular applications so far developed.

Steam Turbine Control Loops

Figure 3:
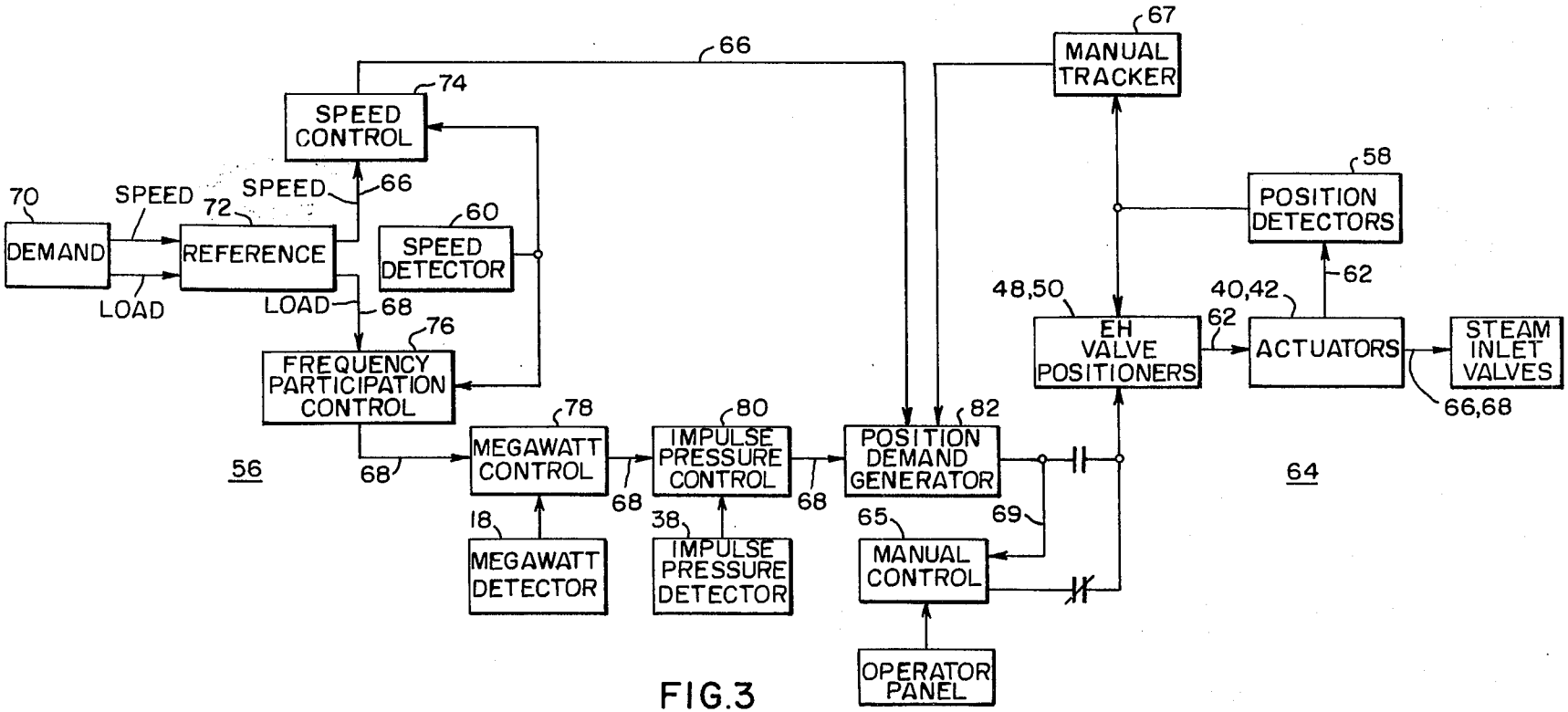
FIG. 3 shows a schematic control loop diagram which represents the functioning of a control system associated with the power plant of FIG. 1.

In FIG. 3, there is shown the preferred arrangement 64 of control loops employed in the control system 11 to provide automatic and manual turbine operation. To provide for power generation continuity and security, a manual backup control 65 is shown for implementating operator control actions during time periods when the automatic control is shut down. Relay contacts effect automatic or manual control operation as illustrated. Bumpless transfer is preferably provided between the manual and automatic operating modes, and for this purpose a manual tracker 67 is employed for the purpose of updating the automatic control on the status of the manual control 65 during manual control operation and the manual control 65 is adapted on the status of the automatic control during automatic control operation as indicated by the reference character 69.

The control loop arrangement 62 is schematically represented by functional blocks, and varying structure can be employed to produce the block functions. In addition, various block functions can be omitted, modified or added in the control loop arrangement 62 consistently with application of the present invention. It is further noted that the arrangement 62 functions within overriding restrictions imposed by elements of an overall turbine and plant protection system (not specifically indicated in FIG. 3).

During startup, an automatic speed control loop 66 in the control loop arrangement 62 operates the turbine inlet valves to place the turbine 10 under wide range speed control and bring it to synchronous speed for automatic or operator controlled sychronization. After synchronization, an automatic load control loop 68 operates the turbine inlet valves to load the turbine 10. The speed and load control loops 66 and 68 function through the previously noted EH valve position control loops 62.

The controller 56 of FIG. 1 is included in the control loops, and it includes a demand block 70. Speed and load demands are generated by the block 70 for the speed and load control loops 64 and 66 under varying operating conditions in response to a remote automatic load dispatch input, a synchronization speed requirement, a load or speed input generated by the turbine operator or other predetermined controlling inputs. A reference generator block 72 responds to the speed of load demand to generate a speed or load reference during turbine startup and load operation preferably so that speed and loading change rates are limited to avoid excessive thermal stress on the turbine parts.

An automatic turbine startup control can be included as part of the demand and reference blocks 68 and 70 and when so included it causes the turbine inlet steam flow to change to meet speed and/or load change requirements with rotor stress control. In that manner, turbine life can be strategically extended.

The speed control loop 66 preferably functions as a feedback type loop, and the speed reference is accordingly compared to a representation of the turbine speed derived from the speed detector 60. A speed control 74 responds to the resultant speed error to generate a steam flow demand from which a setpoint is developed for use in developing valve position demands for the EH valve position control loops 62 during speed control operation.

The load control loop 68 preferably includes a frequency participation control subloop, a megawatt control subloop and an impulse pressure control subloop which are all cascaded together to develop a steam flow demand from which a standpoint is derived for the EH valve position control loops 62 during load control operation. The various subloops are preferably designed to stabilize interactions among the major turbine-generator variables, i.e. impulse pressure, megawatts, speed and valve position. Preferably, the individual load control subloops are arranged so that they can be switched into and out of operation in the load control loop 68.

The load reference and the speed detector output are compared by a frequency participation control 76, and preferably it includes a proportional controller which operates on the comparison result to produce an output which is summed with the load reference. A frequency compensated load reference is accordingly generated to produce a megawatt demand.

A megawatt control 78 responds to the megawatt demand and a megawatt signal from the detector 18 to generate an impulse pressure demand. In the megawatt control subloop, the megawatt error is determined from the megawatt feedback signal and the megawatt demand, and it is operated upon by a proportional plus integral controller which produces a megawatt trim signal for multiplication against the megawatt demand.

In turn, an impulse pressure control 80 responds to an impulse pressure signal from the detector 38 and the impulse pressure demand from the megawatt control to generate a steam flow demand from which the valve position demands are generated for forward application to the EH valve position control loops 62. Preferably, the impulse pressure control subloop is the feedback type with the impulse pressure error being applied to a proportional plus integral controller which generates the steam flow demand.

Generally, the application of feedforward and feedback principles in the control loops and the types of control transfer functions employed in the loops can vary from application to application. More detail on the described control loops is presented in a copending application Ser. No. 247,877, entitled "System And Method For Starting, Synchronizing And Operating A Steam Turbine With Digital Computer Control", filed by T. C. Giras and R. Uram on Apr. 26, 1972 and assigned to the present assignee as well as other copending applications crossreferenced therein.

Speed loop or load flow demand is applied to a position demand generator 82 which generates feedforward valve position demands for application to the EH valve position controls 52, 54 in the EH valve position control loops 62. Generally, the position demand generator 82 employs an appropriate characterization to generate throttle and governor valve position demands as required for implementing the existing control mode as turbine speed and load requirements are satisfied. Thus, up to 80% synchronous speed, the governor valves are held wide open as the throttle valves are positioned to achieve speed control. After transfer, the throttle valves are held wide open and the governor valves are positioned either in single valve operation or sequential valve operation to achieve speed and/or load control. The position demand generator 82 can also include a valve management function as set forth more fully in a copending patent application Serial No. 306,752 entitled "System And Method Employing Valve Management For Operating A Steam Turbine", filed by T. C. Giras and L. B. Podolsky on Nov. 15, 1972 and assigned to the present assignee and related copending applications cross-referenced therein.

Control System

Figure 4:
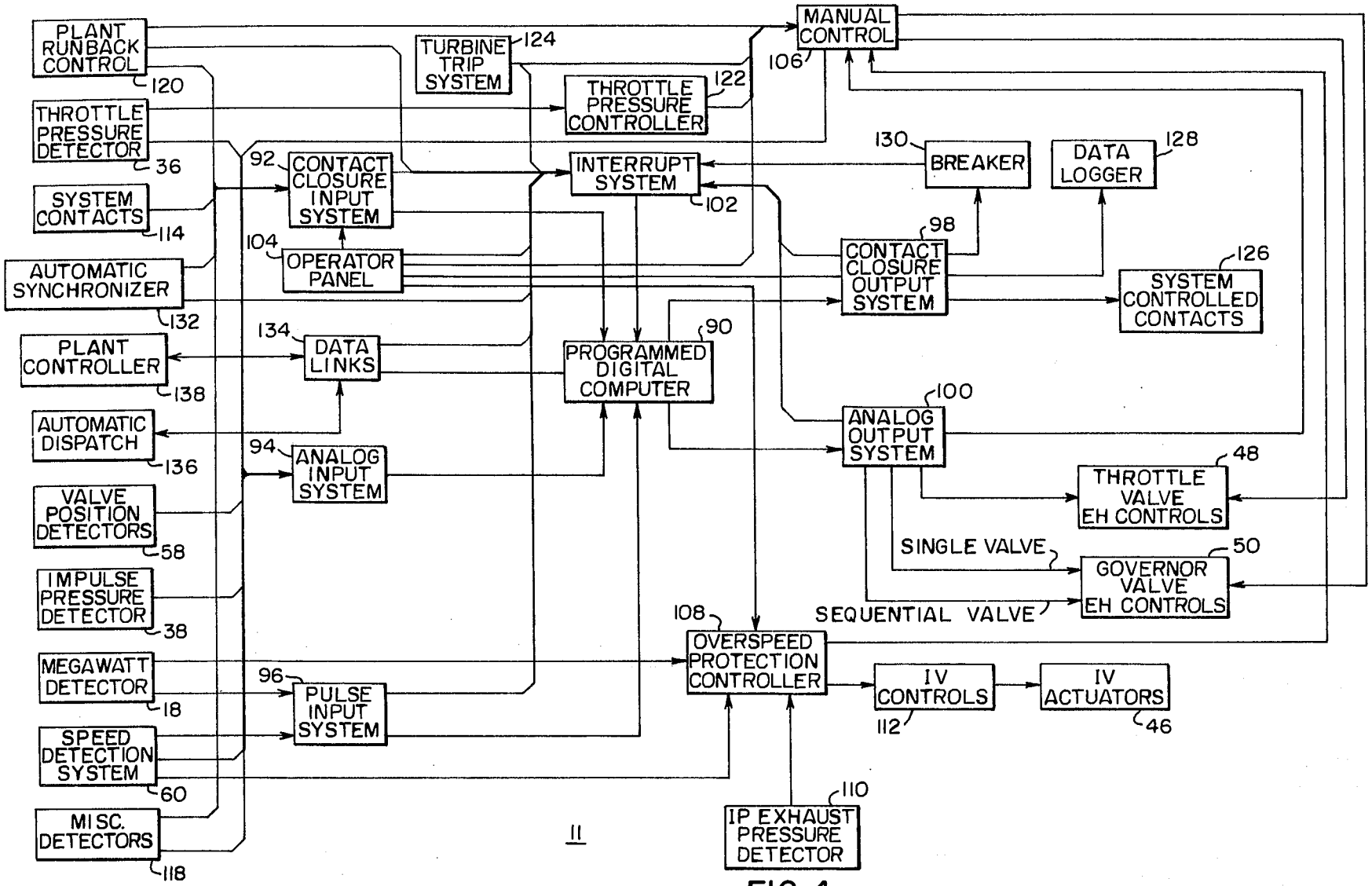
FIG. 4 shows a structural block diagram of the control system in its preferred form.

In its preferred form, the control system 11 includes a programmed digital computer 90 and associated input/output equipment as shown in the block diagram of FIG. 4 where each individual block generally corresponds to a particular structural unit of the control system 11. In relating FIG. 3 with FIG. 4, it is noted that particular functional blocks of FIG. 3 may be embraced by one or more structural blocks of FIG. 4. The computer 90 in this case is a P2000 computer sold by Westinghouse Electric Corporation and designed for real time process control applications, and it operates with a 16-bit word length, 2's complement, and single address in a parallel mode. A 3 microsecond memory cycle time is employed in the P2000 computer and all basic control functions can be performed with a 16K core. Expansion can be made to a 65K core to handle various options includable in particular control systems.

A conventional contact closure input system 92 and analog input system 94 are coupled to the computer 90 to interface system analog and contact signals with the computer at its output. A pulse input system 96 similarly interfaces pulse type system signals with the computer at its input. Computer output signals are interfaced with external controlled device through a suitable contact closure output system 98 and a suitable analog output system 100.

A conventional interrupt system 102 is employed to signal the computer 90 when a computer input is to be executed or when a computer output has been executed. The computer 90 operates immediately to detect the identity of the interrupt and to execute or to schedule execution of the response required for the interrupt.

An operator panel 104 provides for operator control, monitoring, testing and maintenance of the turbinegenerator system. Panel signals are applied to the computer 90 through the contact closure input system 92 and computer display outputs are applied to the panel 104 through the contact closure output system 98. During manual control, panel signals are applied to a manual backup control 106 which is like the manual control 65 of FIG. 2 but is specifically arranged for use with the digital computer 90. More detail on a suitable manual backup control arrangement is set forth in U.S. Pat. No. 3,552,872 issued to T. Giras et al and a copending application Ser. No. 080,710 entitled "Steam Turbine System With Digital Computer Position Control Having Improved Automatic Manual Interaction" filed by A. Braytenbah on Oct. 14, 1970 and assigned to the present assignee.

An overspeed protection controller 108 provides protection for the turbine 10 by closing the governor valves and the interceptor valves under partial or full load loss and overspeed conditions, and the panel 104 is tied to the overspeed protection controller 108 to provide an operating setpoint therefor. The power or megawatt detector 18, the speed detector 60 and an exhaust pressure detector 110 associated with the IP turbine section generate signals which are applied to the controller 108 in providing overspeed protection. More detail on a suitable overspeed protection scheme is set forth in U.S. Pat. No. 3,643,437, issued to M. Birnbaum et al.

Input signals are applied to the computer 90 from various relay contacts 114 in the turbine-generator system through the contact closure input system 92. In addition, signals from the electric power, steam pressure and speed detectors 18, 36, 38 and 60 and steam valve position detectors 50 and other miscellaneous detectors 118 are interfaced with the computer 90. The detectors 118 for example can include impulse chamber and other temperature detectors, vibration sensors, differential expansion sensors, lubricant and coolant pressure sensors, and current and voltage sensors.

Generally, the control loops described in connection with FIG. 3 are embodied in FIG. 4 by incorporation of the computer 90 as a control element in those loops. The manual backup control 106 and its control loop are of course external to the computer 90.

In addition, certain other control loops function principally as part of a protection system externally of the computer 90 or both externally and internally of the computer 90. Thus, the overspeed protection controller 108 functions in a loop external to the computer 90, and a plant runback control 120 functions in a control loop through the computer 90 as well as a control loop external to the computer 90 through the manual control 106. A throttle pressure control 122 functions through the manual control 106 in a control loop outside the computer, and throttle pressure is also applied to the computer 90 for monitoring and control purposes. A turbine trip system 124 causes the manual control and computer control outputs to reflect a trip action initiated by independent mechanical or other trips in the overall turbine protection system.

Contact closure outputs from the computer 90 operate various system contacts 126, a data logger 128 such as an electric typewriter, and various displays, lights and other devices associated with the operator panel 104. Further, in a plant synchronizing system, a breaker 130 is operated by the computer 90 through computer output contacts. If desired, synchronization can be performed automatically during startup with the use of an external synchronizer 132, it can be accurately performed manually with the use of the accurate digital speed control loop which operates through the computer 90, or it can be performed by use of an analog/digital hybrid synchronization system which employs a digital computer in the manner set forth in a copending application Ser. No. 276,508, entitled "System And Method Employing A Digital Computer For Automatically Synchronizing A Gas Turbine Or Other Electric Power Plant Generator With A Power System" filed by J. Ruether on July 31, 1972 as a continuation of an earlier filed patent application and assigned to the present assignee.

The analog output system 100 applies valve position signals to the throttle and governor valve controls during automatic control. Further, the automatic valve position signals are applied to the manual control 106 for bumpless automatic-manual transfer purposes. In manual operation, the manual control 106 generates the position signals for application to the throttle and governor valve controls and for application to the computer 90 for computer tracking needed for bumpless manual-automatic transfer.

Data links 134 interface the turbine computer 10 with an automatic dispatch computer or other controller 136 for system load scheduling and dispatch operations. The data links 134 also provide a tie with a plant digital computer or other controller 138 for integrated plant control purposes, i.e. for suitable coordination of the control of the plant steam generator source 22 and the turbine-generator unit 10, 16.

More detail on a control system like that shown in FIG. 4 is set forth in the aforementioned copending Uram Pat. application Ser. No. 247,877 and other copending applications cross-referenced therein.

Program System For Control Computer

Figure 5:
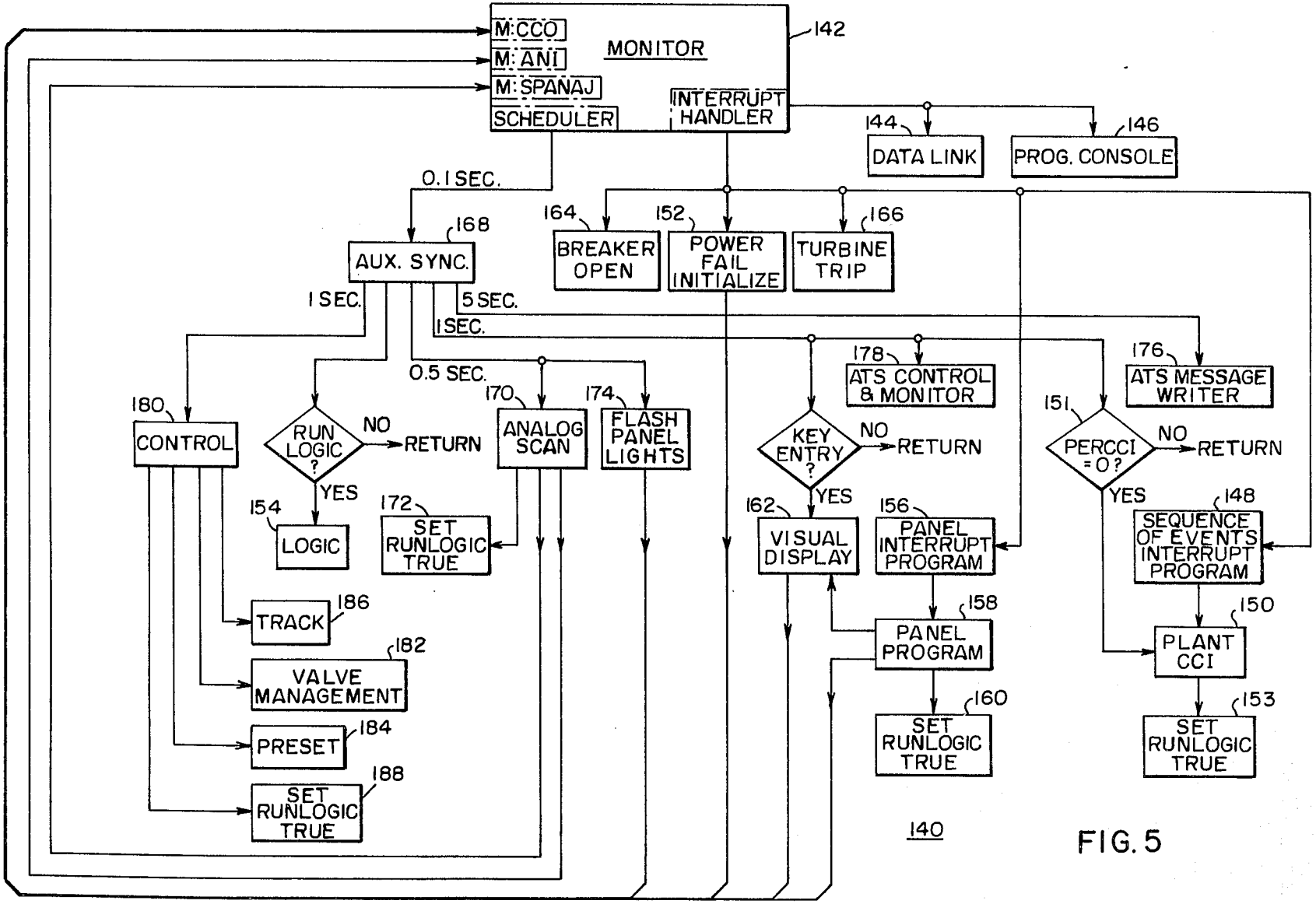
FIG. 5 shows a schematic organization chart for a program system employed in a digital computer which functions as a part of the control system.

A computer program system 140 is preferably organized as shown in FIG. 5 to operate the control system 11 as a sampled data system in providing turbine and plant monitoring and continuous turbine and plant control with stability, accuracy and substantially optimum response. The program system 140 will be described herein only to the extent necessary to develop an understanding of the manner in which the present invention is applied. A program system similar to the program system 140 is disclosed in greater detail in the aforementioned Uram Pat. application Ser. No. 247,877.

A standard executive or monitor program 142 provides scheduling control over the running of programs in the computer 90 as well as control over the flow of computer inputs and outputs through the previously described input/output systems. Generally, each program is assigned to a task level in a priority system, and bids are processed to run the bidding program with the highest priority. Interrupts may bid programs, and all interrupts are processed with a priority higher than any task level.

A data link program 144 is bid on interrupt demand to provide for intercomputer data flow. A programmer's console program 146 is also bid on demand by interrupt and it enables an operator to make parameter and other program system changes.

When a system contact changes state, an interrupt causes a sequence of events interrupt program 148 to place a bid for a scan of all system or plant contacts by a program 150. A periodic bid can also be placed for running the contact closure input program 150 through a block 151. A power fail initialize 152 also can bid the contact closure input program 150 to run as part of the computer initialization procedure during computer starting or restarting. The program 152 also initializes contact outputs through the executive 142. In some instances, changes in contact inputs will cause a bid 153 to be placed for a logic task program 154 to be executed so as to achieve programmed responses to certain contact input changes.

When an operator panel signal is generated, external circuitry decodes the panel input and an interrupt is generated to cause a panel interrupt program 156 to place a bid for the execution of a panel program 158 which provides a response to the panel request. The panel program 158 can itself carry out the necessary response or it can place a bid 160 for the logic task program 154 to perform the response or it can bid a visual display program 162 to carry out the response. In turn, the visual display program 162 operates contact closure outputs to produce the responsive panel display.

Generally, the visual display program 162 causes numerical data to be displayed in panel windows in accordance with operator request. When the operator requests a new display quantity, the visual display program 162 is initially bid by the panel program 158. Apart from a new display request, the visual display program 162 is bid periodically to display the existing list of quantities requested for display.

The pushbuttons and keys on the operator panel 104 are classifiable in one of several functional groups. Some pushbuttons are classified as control system switching since they provide for switching in or out certain control functions. Another group of pushbuttons provide for operating mode selection. A third group of pushbuttons provide for automatic turbine startup and a fourth group provide for manual turbine operation. Another group of pushbuttons are related to valve status/testing/limiting, while a sixth group provide for visual display and change of DEH system parameters. The final group of pushbuttons relate to keyboard activity, i.e. of the entry of numerical data into the computer 90.

A breaker open interrupt program 164 causes the computer 90 to generate a close governor valve bias signal when load is dropped. Similarly, when the trip system 124 trips the turbine 10, a trip interrupt program 166 causes close throttle and governor valve bias signals to be generated by the computer 90. After the governor valves have been closed in response to a breaker open interrupt, the system reverts to speed control and the governor valves are positioned to maintain synchronous speed.

Periodic programs are scheduled by an auxiliary synchronizer program 168 which in turn is bid each tenth of a second by the executive 142. An external clock (not shown) functions as the system timing source. An analog scan program 170 is bid every half second to select analog inputs for updating through an executive analog input handler. After scanning, the analog scan program 170 converts the inputs to engineering units, performs limit checks and makes certain logical decisions. The logic task 154 may be bid by block 172 as a result of an analog scan program run.

A flash panel lights program 174 is also bid every half second to flash predetermined panel lights through the executive contact closure output handler under certain conditions. In the present embodiment, a total of nine conditions are continually monitored for flashing.

The logic program 154 is run periodically to perform various logic tasks if it has been bid. An automatic turbine startup message writer program 176 is run every 5 seconds to provide a printout of significant startup events.

The software control functions are principally embodied in a periodically run automatic turbine startup (ATS) control and monitoring program 178 and a periodically run control program 180, with certain supportive program functions being performed by the logic task 154 or certain subroutines. To provide rotor stress control on turbine acceleration or turbine loading rate in the startup speed control loop 66 or the load control loop 68, rotor stress is calculated by the ATS program 178 on the basis of detected turbine impulse chamber temperature and other parameters.

The ATS program 178 also supervises turning gear operation, eccentricity, vibration, turbine metal and bearing temperatures, exciter and generator parameters, gland seal and turbine exhaust conditions, condenser vacuum, drain valve operation, anticipated steam chest wall temperature, bolt flange differential, and end differential expansion. Appropriate control actions are initiated under programmed conditions detected by the functioning of the monitor system.

Among other functions, the ATS program 178 also sequences the turbine through the various stages of startup operation from turning gear to synchronization. More detail on the ATS program 178 is disclosed in another copending application Ser. No. 247,598 entitled "System And Method For Operating A Steam Turbine With Digital Computer Control Having Automatic Startup Sequential Programming, filed by J. Tanco on Apr. 26, 1972 and assigned to the present assignee.

In the control program 180, program functions generally are directed to (1) computing throttle and governor valve positions to satisfy speed and/or load demand during operator or remote automatic operation and (2) tracking valve position during manual operation. Generally, the control program 180 is organized as a series of relatively short subprograms which are sequentially executed.

In performing turbine control, speed data selection from multiple independent sources is utilized for operating reliability, and operator entered program limits are placed on high and low load, valve position and throttle pressure. Generally, the control program 180 executes operator or automatically initiated transfers bumplessly between manual and automatic modes and bumplessly between one automatic mode and another automatic mode. In the execution of control and monitor functions, the control program 180 and the ATS program 178 are supplied as required with appropriate representations of data derived from input detectors and system contacts described in connection with FIG. 4. Generally, predetermined valve tests can be performed on-line compatibly with control of the turbine operation through the control programming.

The control program 180 logically determines turbine operating mode by a select operating mode function which operates in response to logic states detected by the logic program 154 from panel and contact closure inputs. For each mode, appropriate values for demand and rate of change of demand are defined for use in control program execution of speed and/or load control.

The following speed control modes are available when the breaker is open in the heirarchical order listed: (1) Automatic Synchronizer in which pulse type contact inputs provide incremental adjustment of the turbine speed reference and demand; (2) Automatic Turbine Startup which automatically generates the turbine speed demand and rate; (3) Operator Automatic in which the operator generates the speed demand and rate; (4) Maintenance Test in which the operator enters speed demand and rate while the control system is being operated as a simulator/trainer; (5) Manual Tracking in which the speed demand and rate are internally computed to track the manual control preparatory to bumpless transfer from manual to automatic operation.

The following load control modes are available when the breaker is closed in the heirarchical order listed: (1) Throttle Pressure Limiting in which the turbine load reference is run back at a predetermined rate to a preset minimum as long as the limiting condition exists; (2) Runback in which the load reference is run back at a predetermined rate as long as predefined contingency conditions exist; (3) Automatic Dispatch System in which pulse type contact inputs provide for adjusting the turbine load reference and demand; (4) Automatic Turbine Loading (if included in system) in which the turbine load demand and rate are automatically generated; (5) Operator Automatic in which the operator generates load demand and rate; (6) Maintenance Test in which the operator enters load demand and rate while the control system is being operated as a simulator/trainer; (7) Manual Tracking in which the load demand and rate are internally computed to track the manual control preparatory to bumpless transfer to automatic control.

In executing turbine control within the control loops described in connection with FIG. 3, the control program 180 includes a speed/load reference function. Once the operating mode is defined, the speed/load reference function generates the reference which is used by the applicable control functions in generating valve position demand.

The speed or load reference is generated at a controlled or selected rate to meet the defined demand. Generation of the reference at a controlled rate until it reaches the demand is especially significant in the automatic modes of operation. In modes such as the Automatic Synchronizer or Automatic Dispatch System, the reference is advanced in pulses which are carried out in single steps and the speed/load reference function is essentially inactive in these modes. Generally, the speed/load reference function is responsive to GO and HOLD logic and in the GO condition the reference is run up or down at the program defined rate until it equals the demand or until a limit condition or synchronizer or dispatch requirement is met.

A speed control function provides for operating the throttle and governor valves to drive the turbine 10 to the speed corresponding to the reference with substantially optimum dynamic and steady-state response. The speed error is applied to either a software proportional-plus-reset throttle valve controller or a software proportional-plus-reset governor valve controller.

Similarly, a load control function provides for positioning the governor valves so as to satisfy the existing load reference with substantially optimum dynamic and steady-state response. The load reference value computed by the operating mode selection function is compensated for frequency participation by a proportional feedback trim factor and for megawatt error by a second feedback trim factor. A software proportional-plus-reset controller is employed in the megawatt feedback trim loop to reduce megawatt error to zero.

The frequency and megawatt corrected load reference operates as a setpoint for the impulse pressure control or as a flow demand for a valve management subroutine 182 (FIG. 5) according to whether the impulse pressure control is in or out of service. In the impulse pressure control, a software proportional-plus-reset controller is employed to drive the impulse pressure error to zero. The output of the impulse pressure controller or the output of the speed and megawatt corrected load reference functions as a governor valve setpoint which is converted into a percent flow demand prior to application to the valve management subroutine 182.

The control program 180 further includes a throttle valve control function and a governor valve control function. During automatic control, the outputs from the throttle valve control function are position demands for the throttle valves, and during manual control the throttle valve control outputs are tracked to the like outputs from the manual control 106. Generally, the position demands hold the throttle valves closed during a turbine trip, provide for throttle valve position control during startup and during transfer to governor valve control, and drive and hold the throttle valves wide open during and after the completion of the throttle/governor valve transfer.

The governor valve control function generally operates in a manner similar to that described for the throttle valve control function during automatic and manual operations of the control system 11. If the valve management subroutine 182 is employed, the governor valve control function outputs data applied to it by the valve management subroutine 182.

If the valve management subroutine 182 is not employed, the governor valve control function employs a nonlinear characterization function to compensate for the nonlinear flow versus lift characteristics of the governor valves. The output from the nonlinear characterization function represents governor valve position demand which is based on the input flow demand. A valve position limit entered by the operator may place a restriction on the governor valve position demand prior to output from the computer 90.

Generally, the governor valve control function provides for holding the governor valves closed during a turbine trip, holding the governor valves wide open during startup and under throttle valve control, driving the governor valves closed during transfer from throttle to governor valve operation during startup, reopening the governor valves under position control after brief closure during throttle/governor valve transfer and thereafter during subsequent startup and load control.

A preset subroutine 184 evaluates an algorithm for a proportional-plus-reset controller as required during execution of the control program 180. In addition, a track subroutine 186 is employed when the control system 11 is in the manual mode of operation.

Certain logic operations are performed by the logic program 154 in response to a control program bid by block 188. The logic program 154 includes a series of control and other logic tasks which are related to various parts of the program system 140 and it is executed when a bid occurs on demand from the auxiliary synchronizer program 168 in response to a bid from other programs in the system.

Generally, the purpose of the logic program 154 is to define the operational status of the control system 11 from information obtained from the turbine system, the operator and other programs in the program system 140. Logic tasks included in the program 154 include the following: flip-flop function; maintenance task; speed channel failure monitor lamps; automatic computer to manual transfer logic; operator automatic logic; GO and HOLD logic; governor control and throttle control logic; turbine latch and breaker logic; megawatt feedback, impulse pressure, and speed feedback logic; and automatic synchronizer and dispatch logic.

During automatic computer control, the valve management subroutine 182 develops the governor valve position demands needed to satisfy steam flow demand and ultimately the speed/load reference and to do so in either the sequential or the single valve mode of governor valve operation or during transfer between these modes. Mode transfer is effected bumplessly with no load change other than any which might be demanded during transfer. Since changes in throttle pressure cause actual steam flow changes at any given turbine inlet valve position, the governor valve position demands may be corrected as a function of throttle pressure variation. In the manual mode, the track subroutine 186 employs the valve management subroutine 182 to provide governor valve position demand calculations for bumpless manual-automatic transfer.

Governor valve position is calculated from a linearizing characterization in the form of a curve of valve position (or lift) versus steam flow. A curve valid for low-load operation is stored for use by the valve management program 182 and the curve employed for control calculations is obtained by correcting the stored curve for changes in load or flow demand and preferably for changes in actual throttle pressure. Another stored curve of flow coefficient versus steam flow demand is used to determine the applicable flow coefficient to be used in correcting the stored low-load position demand curve for load or flow changes. Preferably, the valve position demand curve is also corrected for the number of nozzles downstream from each governor valve.

In the single valve mode, the calculated total governor valve position demand is divided by the total number of governor valves to generate the position demand per valve which is output as a single valve analog voltage (FIG. 4) applied commonly to all governor valves. In the sequential mode, the governor valve sequence is used in determining from the corrected position demand curve which governor valve or group of governor valves is fully open and which governor valve or group of governor valves is to be placed under position control to meet load references changes. Position demands are determined for the individual governor valves, and individual sequential valve analog voltages (FIG. 4) are generated to correspond to the calculated valve position demands. The single valve voltage is held at zero during sequential valve operation and the sequential valve voltage is held at zero during single valve operation.

To transfer from single to sequential valve operation, the net position demand signal applied to each governor valve EH control is held constant as the single valve analog voltage is stepped to zero and the sequential valve analog voltage is stepped to the single valve voltage value. Sequential valve position demands are then computed and the steam flow changes required to reach target steam flows through individual governor valves are determined. Steam flow changes are then implemented iteratively, with the number of iterations determined by dividing the maximum flow change for any one governor valve by a predetermined maximum flow change per iteration. Total steam flow remains substantially constant during transfer since the sum of incremental steam flow changes is zero for any one iteration.

To transfer from sequential to single valve operation, the single valve position demand is determined from steam flow demand. Flow changes required to satisfy the target steam flow are determined for each governor valve, and an iteration procedure like that described for single-to-sequential transfer is employed in incrementing the valve positions to achieve the single valve target position substantially without disturbing total steam flow. If steam flow demand changes during any transfer, the transfer is suspended as the steam flow change is satisfied equally by all valves movable in the direction required to meet the change.

Rotor Blade Loading Produced Under Various Turbine Operating Conditions

Figure 6:
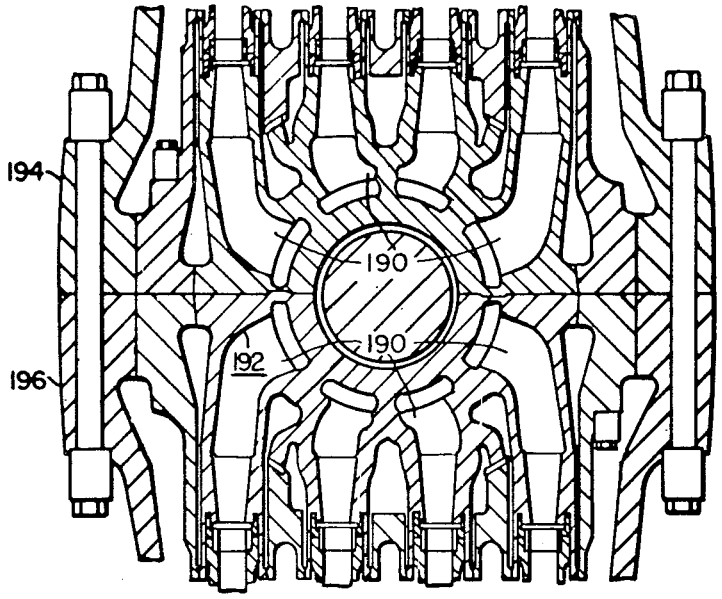
FIGS. 6–8 show various sectional views of a typical steam turbine to illustrate the manner in which steam is admitted to drive the turbine rotor blades.

To illustrate more specifically the blade loading conditions which can foreshorten turbine life and cause discontinuity in the generation of power by the plant 12, there is shown in FIG. 6 a partial section of a typical HP turbine structure which can be used in embodying the turbine 10. The section of FIG. 6 is taken across a lateral reference plane through the HP turbine section at a longitudinal location where the nozzle block structure is provided to direct inlet steam into the HP turbine against the rotor impulse blades.

A total of 8 channels are provided for steam flow from the respective governor valves to nozzle steam chambers 190 arcuately spaced about the turbine in a nozzle block 192. In turn, the nozzle block 192 is supported in place with upper and lower HP turbine casing members 194 and 196.

Figure 7:
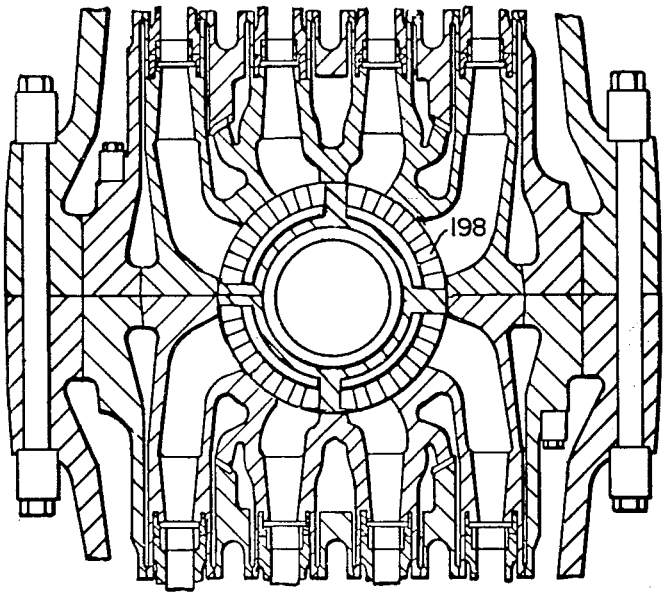

In FIG. 7, there is shown a partial cross-section similar to the partial cross-section of FIG. 6 but it is taken across a lateral reference plane in the typical turbine structure at a point downstream from the lateral reference plane used for FIG. 6. Accordingly, in FIG. 7 there is illustrated an annular array of nozzle vanes 198 which form part of the nozzle block 192 and which function as nozzles in directing the inlet steam generally in the axial or longitudinal direction against the rotor impulse blades.

Figure 8:
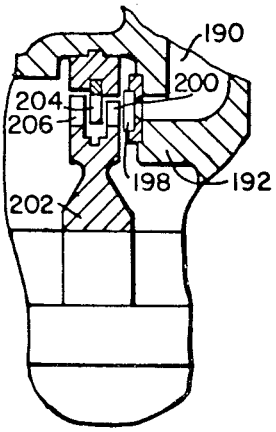

The relationship between the nozzle vanes and the rotor blade structure is illustrated in a partial longitudinal section shown in FIG. 8 for a typical turbine structure. In this view, a nozzle vane 198 is shown in relation to a nozzle steam chamber 190 within the nozzle block 192. Steam generally is directed through the space between adjacent nozzle vanes 198 from the nozzle chamber 190 and axially against a row of impulse blades 200 on a rotor 202, a row of stationary vanes 204 and a row of rotor reaction blades 206. From that point, steam flows along the turbine through additional blade stages (not shown).

Figure 9A:
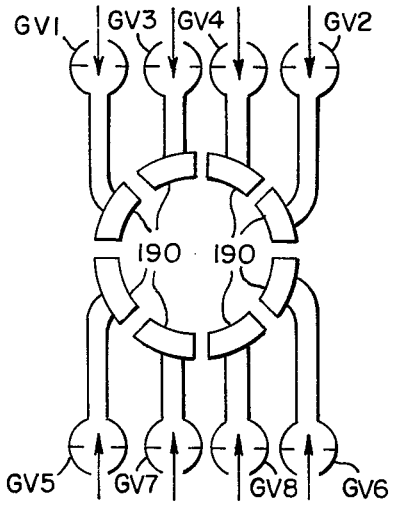
FIGS. 9A–9E are schematic representations of various steam admission arc patterns.
Figure 9B:
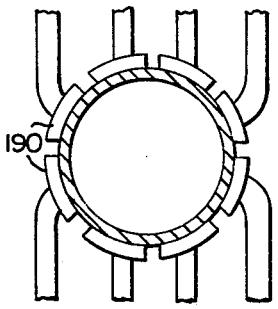

In FIGS. 9A through 9E there are schematically shown various steam admission arc patterns produced by various operating combinations of the governor valves. In FIG. 9A, all governor valves are closed and no steam is being admitted through the nozzle steam chambers 190. In FIGS. 9B–9E, inlet steam flow is denoted by shading. Thus, in FIG. 9B, there is shown a full admission arc produced when all of the governor valves are open. In the full admission arc, no shock or other undesirable loading is produced on the rotor blades unless a single governor valve fails closed to produce a partial arc in which a single rotor blade shock condition arises or unless multiple governor valves fail closed to produce multiple partial arcs and cause a multiple rotor blade shock condition. In the latter case, multiple shock is avoided by turbine shutdown and governor valve repair.

Figure 9C:
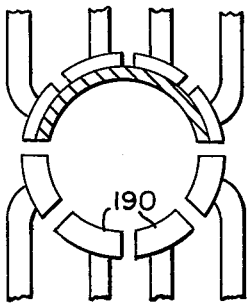

In FIG. 9C, there is shown a typical partial admission arc associated with the sequential valve mode of operation. A single rotor blade shock condition exists in this case, and it is a shock which is considered in blade and rotor design and tolerated when sequential valve operation is desired.

Figure 9D:
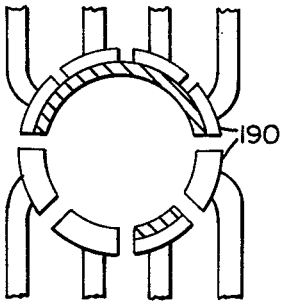

In FIG. 9D, there is shown a turbine operating condition in which two partial steam admission arcs exist as a result of failure of governor valve GV6 in the closed position. Undesirable rotor blade loading principally including vibratory stresses occurs as the rotor blades rotate through a time dependent force field created by the partial arcs. In this case, double rotor blade shock exists.

Figure 9E:
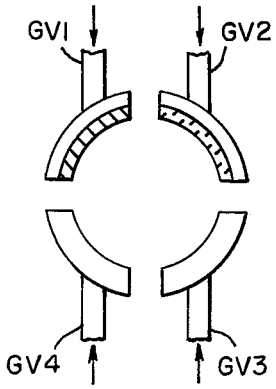

In FIG. 9E, there is shown an arrangement with a single partial steam admission arc in a turbine having four governor valves instead of eight governor valves. The partial arc is divided into two parts, with the arc portion associated with governor valve GV1 having low flow due to failure of the valve GV1 at a partially open position. The steam admission arc associated with the governor valve GV2 has high steam flow as a result of the failure of the governor valve GV1. The governor valves GV3 and GV4 are closed at this particular point of sequential valve operation. Substantial undesirable rotor blade loading can occur as the blades enter the GV1 partial arc and again as they enter the GV2 partial arc to create a double blade shock condition.

As already indicated, excessive blade loading due to cyclical and vibratory blade stresses can foreshorten turbine blade life and diminish power system security and power system economy by causing unscheduled and costly plant outages. Vibratory blade stresses can produce the most damaging effects since blades are typically structured to withstand normal steady and normal fluctuating drive stresses and since temperature induced sequential mode stresses are comparatively small.

Turbine Rotor Blade Protection System

In providing protective control action for the turbine 10 against excessive rotor blade loading in the sequential mode, it is preferred that the governor valve flow arrangement be reconfigured, i.e. preferably that the turbine 11 be switched on-line from sequential valve operation to single valve operation substantially without disturbing plant power output. In taking such protective control action, a distinction is made between those steam admission arc conditions which should be protected against and those which should not so as not to defeat the very capability of turbine sequential valve operation and further so as to restrict the number of protective transfers from sequential valve to single valve operation for turbine life management purposes. A distinction can also be made between actual undesirable steam arc conditions and a detection system failure which creates the appearance of an undesirable steam arc condition.

In a typical steam turbine, the structural design of the various turbine parts and the specification for the governor valve sequence are coordinated such that partial steam admission arc operation causes only a single rotor blade shock as blades enter the admission arc and substantially produces only relatively small blade loading changes on a rotor blade as it progresses through successive steam segments which, although within the arc, may have different steam flow levels due to differing positions of the respective governor valves associated with those arc segments. Therefore, no protection is provided against normal differences in steam flow between successive arc segments in sequential valve operation. Moreover, since the very act of transferring from sequential valve to single valve operation involves the generation of thermal stress transients on the rotor because of rotor surface temperature changes, protective governor valve mode transfer are preferably made during abnormal sequential valve flow conditions only if the rotor blade loading condition is sufficiently excessive to justify the rotor stress transient produced by a protective mode transfer.

In the present case, valve position feedback is generated as a representation of steam admission arc status protective governor valve mode transfers from sequential valve to single valve operation preferably occur if a governor valve fails closed against required opening or fails open against required closure. Accordingly, in the present embodiment, protection system operation is based on detection of failure of governor valves or governor valve servo-loops. Such failures can be due for example to a clogged Moog valve, a sticking valve stem or other causes.

If the position detection feedback system fails, the result could be equivalent to a valve loop failure since improper feedback signals would normally cause governor valve movement to full closed or full open positions in an attempt to satisfy steam flow demand. To avoid an unnecessary protective mode transfer in that event, governor valve position limit detectors (FIG. 10) can be used as a redundant type check to defeat a transfer otherwise triggerable by a position detector feedback system failure.

Figure 10:
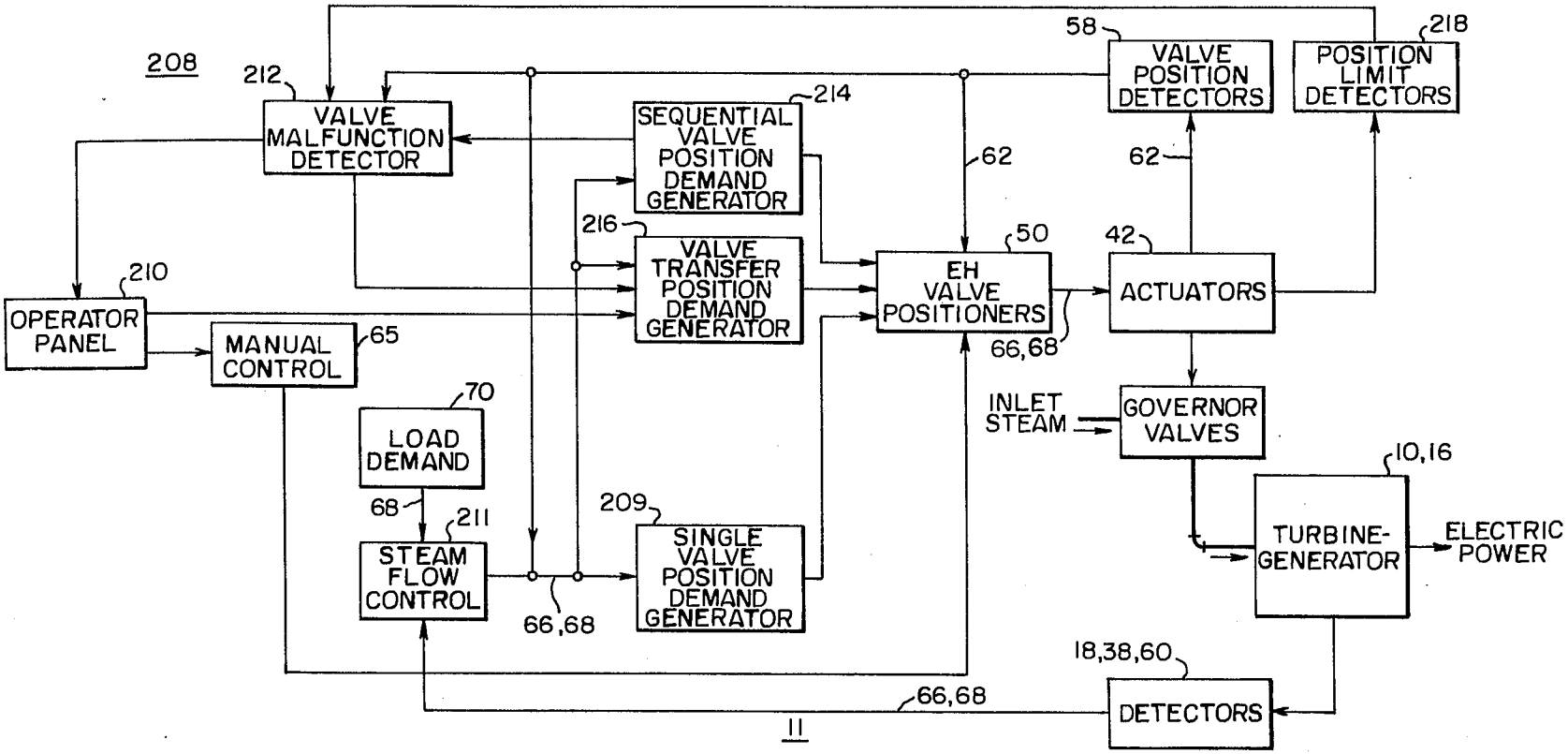
FIG. 10 shows a schematic block diagram of a turbine rotor blade protection system which is arranged in accordance with the principles of the invention for incorporation in the power plant shown in FIG. 1.

As shown in a functional block diagram in FIG. 10, a system 208 for protecting the turbine rotor blades against cyclic or vibratory stress while maintaining power generation continuity is arranged in accordance with the principles of the invention. The blade protection system 208 employs the control system 11 as functionally diagrammed in FIG. 3 and it therefore includes previously considered elemental aspects of the control system 11. In the description of the blade protection system 208 and in the related protection system drawings, like reference characters are employed where functional blocks or structural elements previously considered herein are employed. As already indicated, the present description is directed to disclosure which is aimed at providing a full understanding of the invention, and more complete details on the structure and operation of various control system elements as related to embodiment of the present invention can be obtained in the previously noted copending applications Ser. No. 247,877 and Ser. No. 306,752 which are hereby incorporated by reference.

In the blade protection system 208, the speed control loop 66 and the load control loop 68 function automatically in the manner previously described to control speed and load of the turbine-generator 10, 16 during normal turbine startup and load operations. If the governor valves are in the single valve mode, a single valve position demand generator 209 produces a position setpoint for the governor valves and the protection system 208 causes a signal at an operator panel 210 if a governor valve failure is detected but no control action is initiated. Generally, a steam flow demand control 211 includes the previously disclosed controls 60, 76, 78 and 80 (FIG. 3) to develop an input from which position demands are generated.

In the sequential mode, the blade protection system 208 causes an operator panel signal without control action for less significant governor valve failures and an operator panel signal with appropriate automatic control action for more significant governor valve failures. A valve malfunction detector 212 has applied to it actual position demand generated in the control loops 66, 68 by a sequential valve position demand generator 214 and an actual position feedback representation for each governor valve.

The position demand and the position feedback are compared for each governor valve and if an alarm difference exists the operator panel signal is generated. Further, if the difference indicates that the associated governor valve has failed closed when it should be open or failed open when it should be closed, mode transfer is initiated through a valve transfer position demand generator 216 and single valve operation is commenced as previously described. Valve stem limit switches 218 can be employed to provide position limit detection and prevent mode transfer by the malfunction detector 212 if a comparison of the limit switch feedback with the corresponding governor valve position feedback indicates the failure to be a feedback system failure rather than a governor valve or governor valve servo-loop failure. In FIG. 10, the position demand generators 209, 214 and 216 together constitute the position demand generator 82 of FIG. 3.

Reference is also made to an earlier filed copending application Ser. No. 247,853 entitled "System And Method For Operating A Steam Turbine With Digital Computer Control Having Contingency Functions Therein," filed by A. Braytenbah, et al on Apr. 26, 1972 wherein there is included disclosure on a valve failure contingency monitoring system. The present disclosure employs a valve failure monitoring system and it further includes an arrangement for initiating control actions in the event of certain valve contingencies.

Figure 11:
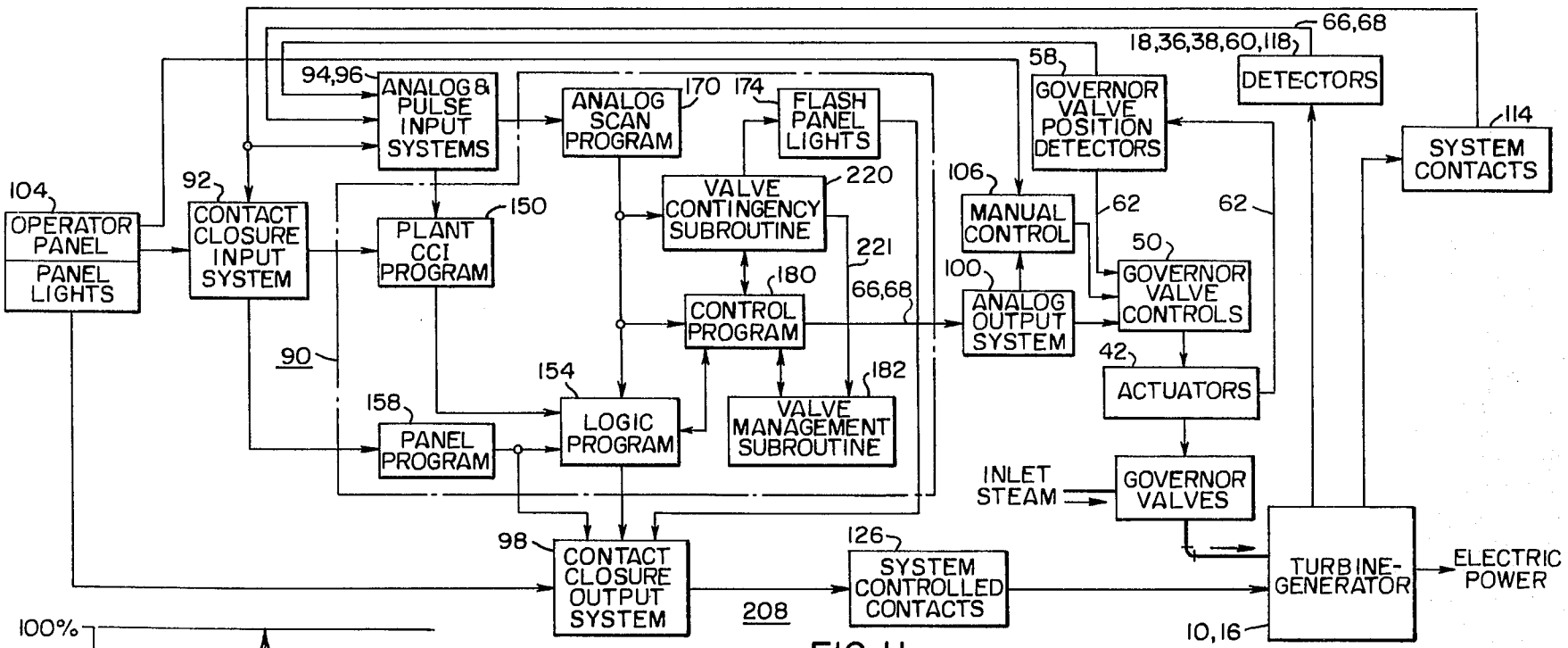
FIG. 11 shows the rotor blade protection system in greater detail.

In FIG. 11, the blade protection system 208 is shown in greater detail as it is embodied with the computer control system of FIG. 4 with its program system 140 of FIG. 5. In order to provide clarity in illustration of the invention, the block diagram of FIG. 11 is set forth with a mixture of computer program blocks and external hardward blocks in accordance with general interrelationships among them in the blade protection system 208.

Similarly to the case of FIG. 10, the speed and load control loops in FIG. 11 function automatically as previously described during normal turbine operations. A single valve control signal is generated by the control program 80 and the valve management subroutine 182 through the analog output system 100 during single valve operation in the startup and/or load operation of the turbine 10 and the generator 16. Governor valve sequential position demand signals are also generated by the control program 180 and the valve management subroutine 182 through the analog output system 100 during sequential mode operation in the startup and/or load operation of the turbine 10 and the generator 16. If a transfer is to be made between sequential and single governor valve operating modes, the valve management subroutine 182 causes bumpless transfer to occur in the manner previously described.

The governor valve position detector 58 generate signals which are applied to the analog input system 94 for input to the computer 90. Under programmed computer operation, representations of governor valve positions are applied by the analog scan program 170 to a valve contingency subroutine 220 for valve malfunction detection. If a difference exists between the position demand generated by the valve management subroutine 182 for any governor valve and the position feedback representation for that valve, a panel lamp is flashed on the operator panel 104 through the contact closure output system 98. If desired, the difference quantity which triggers a panel lamp flashing can be required to persist for a delay period before flashing so as to reflect response delays in valve positioning upon changes inn valve position demand. However, such a provision is not included in the present case since only momentary flashing typically occurs in such circumstances.

If a failure occurs in a governor valve or in a governor valve servo-loop including the governor valve control 50 and the actuator 42 such that the governor valve has failed closed when it should be open or failed open when it should be closed, mode transfer is automatically initiated as indicated by reference character 221 from sequential to single valve operation by the valve contingency subroutine 220 and the valve management subrouting 182 through the analog output system 100. Preferably, governor valve mode transfer is initiated when such a governor valve contingency is detected even if the particular governor valve under failure simply makes an existing partial steam invention arc shorter or longer at the existing steam flow demand, i.e. even though a multiple rotor blade shock condition does not then exist. This preference is based on the fact that a change in load could at any time cause a steam flow demand which would result in a multiple rotor blade shock condition. If the control system 11 is transferred at some point in time from the automatic to the manual mode of operation, the governor valves are operated in the single valve mode by the manual control 106 and any transfer from single to sequential valve operation which may be underway in the protection system 208 at the time of transfer is suspended.

In the control functioning of the blade protection system 208, the valve contingency subroutine 220 makes a comparison between the position demand and the actual feedback value for each governor valve. If the position demand signal is greater than a predetermined deadband signal which represents a minimal valve opening required before the steam flow through the valve is enough to be considered a partial arc, and if the feedback indicates that the actual position is within the deadband, a valve failed closed is presumed. A multiple rotor blade shock condition could then exist and a transfer is made from sequential valve operation to single valve operation.

Similarly, if the position demand signal is within the deadband and the feedback is greater than the deadband, a valve failed open is presumed. The valve contingency subroutine 220 accordingly initiates a control action resulting in transfer of the turbine operating mode from sequential to single valve operation. In these cases where control actions are initiated as well as in the previously considered cases where only monitoring actions are taken, the valve contingency subroutine 220 causes panel lights to be flashed on the operator panel 104.

Figure 12:
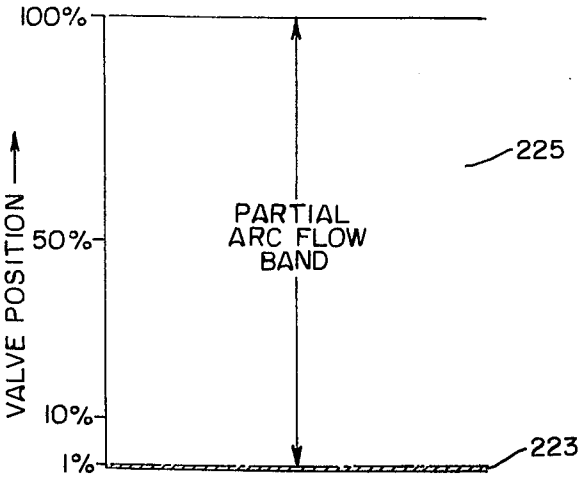
FIG. 12 shows a graphical representation of the conditions upon which a protective governor valve mode transfer is undertaken.

As shown by the graphical representation in FIG. 12, the programmed deadband can for example be defined as the band from zero position setpoint to 1% position setpoint as indicated by the reference character 223. A valve position setpoint band 225 from 1% to 100% constitutes a region of operation in which the segment steam flow associated with a governor valve is sufficient to cause double or multiple shock. With use of the deadband test, the valve contingency subrouting 220 avoids unnecessary mode transfers (i.e. where insufficient steam flow exists to cause excessive blade loading) and further enables sequential governor valve operation to occur in a manner such that steam flow through a governor valve taking over position control can be cut back to allow full opening movement of a governor valve going out of positioning control without causing a governor valve contingency which would otherwise trigger a protective transfer from sequential valve operation to single valve operation.

Figure 13:
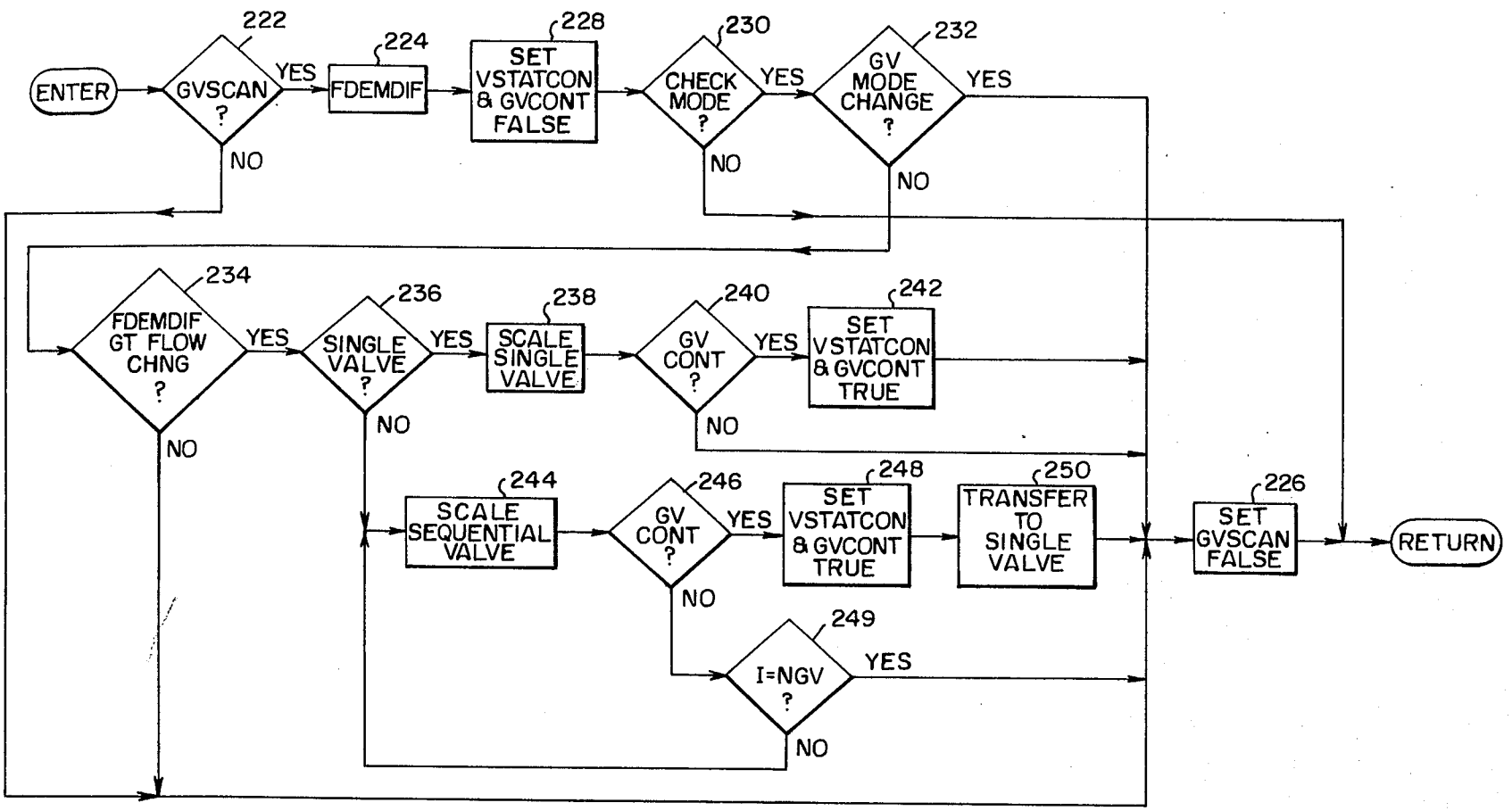
FIG. 13 shows a flow chart of the steps employed in a governor valve contingency program which forms a part of the rotor blade protection system.

The valve contingency subroutine 220 is illustrated more fully by a flow chart in FIG. 13. In block 222, a check is made on the flag GVSCAN to determine whether an updated set of governor valve position values have been generated by the analog scan program 170 thereby to limit the valve contingency program runs to once per governor valve scan, i.e. once each 5 seconds. if so, the difference in the steam flow demand from the last program run is calculated in block 224 and a flasher lamp flag VSTATCON and a governor valve contingency flag GVCONT are set false in block 228. If not, block 226 sets the flag GVSCAN false and the program run is ended.

If updated analog scan values are available, block 230 next checks to determine whether the turbine operating mode is turbine manual, test or throttle valve to governor valve transfer. If so, the program run is ended. If not, block 232 checks whether a governor valve mode transfer is in progress and if so the program run ends through the block 226 because of the dynamic state of the governor valves.

If no governor valve mode change is in progress, block 234 determines whether the control program has changed the steam flow demand by a minimum amount since the last valve contingency subroutine run. For example, the minimum amount FLOWCHNG can be 1% flow change. If there has been sufficient change in the steam flow demand, the subroutine run is ended through the block 226. If there has been insufficient steam flow demand change, steps are taken to test for a governor valve contingency.

In the valve contingency check, block 236 determines whether the governor valve mode is the single valve mode. If so, block 238 scales the single valve position feedback values and block 240 makes a governor valve contingency check by comparing the feedback position and position demand values as described in connection with FIG. 12. If a governor valve contingency exists, the flashlamp and governor valve contingency flags VSTATCON and GVCONT are set true in block 242 and the subroutine run is ended through the block 226. If no governor valve contingency exist, the subroutine run is directly ended through the block 226.

If the check in the block 236 indicates a sequential valve mode of operation, block 244 scales the sequential valve position feedback values and block 246 makes a valve contingency check. The subroutine loops through the block 246 as indicated by block 249 until all governor valves have been checked for a contingency by a comparison of actual position feedback values against position demands as described in connection with FIG. 12. If no governor valve is in a contingency status, the subroutine run is ended through the block 226. If a governor valve contingency is detected by the block 246, a block 248 sets the flashlamp and governor valve contingency flags VSTATCON and GVCONT true and a block 250 initiates a transfer from sequential valve operation by setting appropriate flags to run the logic program 154 and cause the valve management subroutine 182 to effect the transfer. After the block 250 is executed, the valve contingency subroutine run ends through the block 226.

The following is a Fortran listing of a valve contingency subroutine arranged in accordance with the principles of the invention and it embodies program functions like those just described with respect to protective governor valve monitoring and control functions as well as protective throttle valve monitoring functions:

```
VALVE CONTINGENCY/MANUAL NOT TRACKING PROGRAM                    0266
46      IF(.NOT. GVSCAN) GO TO 461                               0270
        FDEMDIFF=FDEM-FDEMLAST                                   0271
        FDEMDIF=ABS(FDEMDIFF)                                    0272
        IF(.NOT. TVCONT) VSTATCON = .FALSE.                      0273
        GVCONT = .FALSE.                                         0274
461     IF(.NOT. TVSCAN) GO TO 465                               0275
        IF(.NOT. GVCONT) VSTATCON = .FALSE.                      0276
        TVCONT = .FALSE.                                         0277
465     MANOTRAK = .FALSE.                                       0278
        IF(TM .OR.(NVTEST .NE. O) .OR. TRTVGV)
        GO TO 50                                                 0279
        ITEMP1 = 2*IGVAO(10)                                     0280
        DO 48 I = 1,NOVLV                                        0281
        IF(I .GT. NTV) GO TO 47                                  0282
C       CHECK ITHROTTLE VALVE CONTINGENCY                        0283
        IF(.NOT. TVSCAN) GO TO 47                                0284
        IF((ITEMP1 .LT. ITVDB) .AND. (ITVSS(I)
        .GT.ITVDB)) GO TO 471                                    0285
        IF((ITEMP1 .GT. ITVDB) .AND. (ITVSS(I)
        .LT. ITVDB)) GO TO 471                                   0286
        GO TO 47                                                 0287
471     VSTATCON = .TRUE.                                        0288
        TVCONT = .TRUE.                                          0289
47      IF(.NOT. GVSCAN) GO TO 48                                0290
        IF((TRFPG .OR. MODCH) .AND. (.NOT. SINGLV))
        GO TO 48                                                 0291
        IF(FDEMDIF.GT.FLOWCHNG) GO TO 48                         0292
        IF(SINGLV) GO TO 475                                     0293
        CHECK SEQUENTIAL VALVE                                   0294
        ITEMP = 2*IGVAO(I+1)                                     0295
        GO TO 477                                                0296
        CHECK SINGLE VALVE                                       0297
475     ITEMP = 4*(IGVADO(1) - 1024)                             0298
477     IF((ITEMP .LT. IGVDB) .AND. (IGVSS(I)
        .GT. IGVDO1)) GO TO 478                                  0299
        IF((ITEMP .GT. IGVDB1) .AND. (IGVSS(I)
        .LT. IGVDB)) GO TO 478                                   0300
        GO TO 48                                                 0301
478     VSTATCON = .TRUE.                                        0302
        GVCONT = .TRUE.                                          0303
        IF(SINGLV) GO TO 48                                      0304
        SINGLV = .TRUE.                                          0305
        MODCH = .TRUE.                                           0306
        RUNLOGIC = .TRUE.                                        0307
48      CONTINUE                                                 0308
        TVSCAN = .FALSE.                                         0309
        GVSCAN = .FALSE.                                         0310
C               CHECK MANUAL NOT TRACKING                        0312
        IF(.NOT. ASL) GO TO 50                                   0314
        TEMP=ITVAD-ITVMAN                                        0315
        IF(ABS(TEMP) .GE. TVMANDB) GO TO 49                      0316
        TEMP=ISVAO-IGVMAN                                        0317
        IF(ABS(TEMP) .LT. GVMANDB) GO TO 50                      0318
49      MANOTRAK=.TRUE.                                          0319
50      FDEMLAST=FDEM                                            0320
```

In summary, a turbine rotor blade protection system is provided to avoid excessive rotor blade loading or multiple shock due to arc steam flow patterns in the partial arc mode of operation. Preferably, transfer is made to single valve operation when excessive blade loading is detected. To protect the rotor against unnecessary thermal cycling, mode transfers for blade protection are preferably made only if the excessive rotor blade loading is sufficient to warrent the penalty of a mode transfer rotor thermal cycle. To provide plant power generation continuity, mode transfer automatically initiated for rotor blade protection are preferably made bumplessly. With use of the blade protection system, blade life and turbine life are extended to provide lower cost power plant operation and more secure power system operation.

What is claimed is:

1. An electric power plant comprising a steam turbine having a plurality of turbine sections, said turbine having a plurality of inlet valves including a plurality of governor valves for supplying inlet steam to drive a turbine rotor, a generator driven by said turbine to produce electric power, a rotor blade protection system including means for automatically controlling the operation of said governor valves in a sequential valve mode or a single valve mode to meet load demand, said controlling means including means for transferring between sequential and single valve operating modes during turbine load operation substantially without disturbing the output of said generator, said controlling means further including means for responding to representations of predetermined parameters which are related to steam flow through the governor valves to detect excessive rotor blade loading conditions and to cause said transferring means protectively to transfer the turbine from the sequential valve mode to the single valve mode if the turbine is in the sequential valve mode and if the predetermined parameters are interrelated in a manner which indicates an excessive blade loading condition.

2. An electric power plant as set forth in claim 1, wherein means are provided for generating signals representative of governor valve positions, said controlling means generates representations of governor valve position demands, and said responding means reacts to said position signals and the position demand representations to cause protective valve mode transfer to the single valve mode if the turbine is in the sequential mode and if actual and demand valve positions are related in a predetermined manner.

3. An electric power plant as set forth in claim 2, wherein a programmed digital computer is provided, said controlling means includes said computer, said computer includes means for generating representations of valve position demand to implement load control in a load control loop, said computer generating means further generates representations of valve position demand during valve mode transfers to achieve substantially bumpless transfer during turbine load operation, said computer further includes means for generating a governor valve contingency representation when representations of actual governor valve positions and position demands show an excessive blade loading condition, and said computer includes means for causing said computer position demand generating means to transfer said turbine protectively from the sequential valve mode to the single valve mode if the turbine is in the sequential valve mode when a governor valve contingency representation is generated.

4. An electric power plant as set forth in claim 3, wherein an electrohydraulic control loop is provided for operating each governor valve, means are provided for applying valve position demand signals to said electrohydraulic control loops in correspondence to the computer generated valve position demand representations, means are provided for generating signals representative for governor valve positions, means are provided in said electrohydraulic control loops for responding to the governor valve position signals and the governor valve position demands to control governor valve movement, means are provided for applying the governor valve position signals to the input of said computer and said governor valve contingency generating means reacts to representations of the governor valve position signals and the governor valve position demand representations to generate a governor valve contingency representation if the actual and demand governor valve positions are related in a predetermined manner.

5. A steam turbine arrangement having a plurality of turbine sections and a plurality of inlet valves including a plurality of governor valves for supplying inlet steam to said turbine, and a turbine rotor blade protection system including means for automatically controlling the operation of said governor valves in a sequential valve mode or a single valve mode to meet load demand, said controlling means including means for transferring between sequential and single valve modes substantially bumplessly during turbine load operation, and said controlling means further including means for responding to representations of predetermined parameters which are related to steam flow through the governor valves to detect excessive blade loading conditions and to cause said transferring means protectively to transfer the turbine from the sequential valve mode to the single valve mode if the turbine is in the sequential valve mode and if the predetermined parameters are interrelated in a manner which indicates an excessive blade loading condition.

6. A steam turbine arrangement as set forth in claim 5, wherein means are provided for generating signals representative of governor valve positions, said controlling means generates representations of governor valve position demands, and said responding means reacts to said governor valve position signals and the governor valve position demand representations to cause protective valve mode transfer to the single valve mode if the turbine is in the sequential valve mode and if actual and demand governor valve positions are related in a predetermined manner.

7. A steam turbine arrangement having a plurality of turbine sections and a plurality of inlet valves including a plurality of governor valves for supplying inlet steam to said turbine, and a system for protecting blades on the rotor against multiple shock and associated vibratory stress conditions, said system including means for automatically controlling the operation of said governor valves to meet load demand, said controlling means including means for transferring between sequential and single valve operating modes substantially bumplessly during turbine load operation, means for generating signals representative of the steam flow status of the steam inlet arc associated with each governor valve, and means for responding to representations of the arc status signals and causing the turbine to transfer from sequential valve mode to the single valve mode if the turbine is in the sequential valve mode and if the status of the steam inlet arcs indicates a multiple shock condition.

8. A turbine arrangement as set forth in claim 7, wherein said arc status generating means includes means for generating signals representative of actual governor valve positions, said controlling means includes means for generating governor valve position demand representations, and means are provided for responding to representations of the governor valve positions and the representations of governor valve position demands to cause the turbine to transfer from the sequential valve mode to the single valve mode if the turbine is in the sequential valve mode and if the actual and demand governor valve positions are related in a predetermined manner.

9. A turbine arrangement as set forth in claim 5, wherein said responding means is structured to detect a blade loading condition as being excessive if the blade loading is more undesirable than the rotor thermal transient associated with a mode transfer.

10. A turbine arrangement as set forth in claim 5, wherein means are provided for generating signals representative of governor valve positions, said controlling means generates representations of governor valve position demands, and said responding means reacts to said position detecting means and to the position demand representations to cause protective valve mode transfers if the turbine is in the sequential valve mode and if a governor valve is substantially open when it should be closed or if a governor valve is substantially closed when it should be open.

11. A turbine arrangement as set forth in claim 5, wherein a programmed digital computer is provided, said controlling means includes said computer, said computer includes means for generating representations of valve position demand to implement load control in a load control loop, said computer generating means further generates representations of valve position demand during valve mode transfer to achieve substantially bumpless valve transfer during load operation, said computer further includes means for generating a governor valve contingency representation if governor valve positions and position demands show an excessive blade loading condition, and said computer includes means for causing said computer position demand generating means to transfer said turbine protectively from the sequential valve mode to the single valve mode if the turbine is in the sequential valve mode when a governor valve contingency representation is generated.

12. A turbine arrangement as set forth in claim 11, wherein said valve contingency generating means generates a governor valve contingency representation if a governor valve is substantially open when it should be closed or if a governor valve is substantially closed when it should be open.

13. A turbine arrangement as set forth in claim 5, wherein means are provided for generating an alarm indication of any protective governor valve mode transfer.

14. A turbine arrangement as set forth in claim 11, wherein said computer further includes means for generating a governor valve contingency alarm signal when a protective valve mode transfer is initiated, and means are provided for generating a visual alarm in response to the alarm signal.

15. A turbine arrangement as set forth in claim 11, wherein a manual backup control is provided for operating the turbine governor valves, and said computer includes means for preventing the generation of governor valve alarms if the turbine is under manual backup control.

16. A turbine arrangement as set forth in claim 11, wherein said computer further includes means for preventing protective mode transfer initiations and governor valve contingency alarms by said governor valve contingency generating means if the turbine is undergoing a transfer between throttle valve and governor valve modes of operation or a transfer between governor valve modes of operation during speed or load control.

17. A steam turbine protection control system comprising means for automatically controlling the operation of governor valves associated with the turbine in a sequential valve mode or a single valve mode to meet load demand, said controlling means including means for transferring between sequential and single valve operating modes substantially bumplessly during turbine load operation, and said controlling means further including means for responding to representations of predetermined parameters which are related to steam flow through the governor valves to detect excessive rotor blade loading conditions and to cause said transferring means protectively to transfer the turbine from the sequential valve mode to the single valve mode if the turbine is in the sequential valve mode and if the predetermined parameters are interrelated in a manner which indicates an excessive blade loading condition.

18. A steam turbine protection control system as set forth in claim 17, wherein means are provided for generating signals representative of governor valve positions, said controlling means generates representations of governor valve position demands, and said responding means reacts to said position signals and the position demand representations to cause protective valve mode transfer if the turbine is in the sequential valve mode and if actual and demand governor valve positions are related in a predetermined manner.

19. A steam turbine protection control system as set forth in claim 18, wherein at least one actual position deadband relative to a closed position is associated with each governor valve feedback position representation and said responding means causes protective valve mode transfer if the turbine is in the sequential valve mode and if the position demand is outside the deadband and the actual position is within the deadband or if the position demand is within the deadband and the actual position is outside the deadband.

20. A steam turbine protection control system as set forth in claim 18, wherein a programmed digital computer is provided, said controlling means includes said computer, said computer includes means for generating representations of the valve position demand to implement load control in a load control loop, said computer generating means further generates representations of valve position demand during valve mode transfers to achieve substantially bumpless valve transfer during load operation, said computer further includes means for generating a governor valve contingency representation if the actual and demand governor valve positions are related in a predetermined manner, and said computer includes means for causing said position demand generating means to transfer the turbine protectively from the sequential valve mode to the single valve mode if the turbine is in the sequential valve mode when a governor valve contingency representation is generated.

21. A computer protection control system for steam turbines as set forth in claim 20, wherein said computer includes means for periodically generating representations of actual governor positions corresponding to the governor valve position signals applied to an input of said computer, and said computer includes means for operating said governor valve contingency generating means each time a set of governor valve position inputs is received.

22. A computer protection control system as set forth in claim 21, wherein said computer further includes means for generating a lamp flash signal during a governor valve contingency, and means are provided for flashing an operator display lamp in response to a governor valve contingency flash signal.

23. A method for operating an electric power generating plant comprising operating a steam turbine at synchronous speed to drive an electric generator and produce electric power, operating a plurality of governor valves to supply inlet steam to the turbine, automatically controlling the operation of the governor valves in a sequential valve or a single valve mode to meet load demand, generating representations of predetermined parameters which are related to steam flow through the governor valves, generating a representation of an excessive blade load condition if the turbine is in the sequential valve mode and if the predetermined parameters are related in a predetermined manner to indicate an excessive blade load condition, and protectively transferring the turbine from the sequential valve mode to the single valve mode substantially without disturbing the generated power level if an excessive blade load representation is generated.

24. A method for operating a steam turbine comprising the steps of operating a plurality of governor valves to supply inlet steam to the turbine, operating a plurality of governor valves to supply inlet steam to the turbine, automatically controlling the operation of the governor valves in a sequential valve or a single valve mode to meet load demand, generating representations of predetermined parameters which are related to steam flow through the governor valves, generating a representation of an excessive blade load condition if the turbine is in the sequential valve mode and if the predetermined parameters are related in a predetermined manner to indicate an excessive blade load condition, and protectively transferring the turbine from the sequential valve mode to the single valve mode substantially without disturbing the generated power level if an excessive blade load representation is generated.

25. A method for operating a steam turbine as set forth in claim 24, wherein a representation of an excessive blade loading condition is generated if a governor valve is substantially open when it should be closed or if a governor valve is substantially closed when it should be open and if the turbine is in the sequential valve mode.

* * * * *